United States Patent [19]

Kosoff

[11] 4,448,410

[45] May 15, 1984

[54] ELECTRICALLY-POWERED BABY SWING

[76] Inventor: Harold Kosoff, 22 Sycamore Dr., Burlington, N.J. 08016

[21] Appl. No.: 291,552

[22] Filed: Aug. 10, 1981

[51] Int. Cl.[3] ..... A63G 9/16; A47D 13/10

[52] U.S. Cl. ..... 272/86; 297/273

[58] Field of Search ..... 272/86, 49, 50, 75, 272/89, 146; 128/33; 5/109; 297/273

[56] References Cited

U.S. PATENT DOCUMENTS

| | | | |
|---|---|---|---|
| 2,564,547 | 8/1951 | Schrougham | 272/86 |
| 2,590,920 | 4/1952 | Beegle | 128/33 |
| 2,951,479 | 9/1960 | Sellner | 128/33 |
| 3,311,935 | 4/1967 | Petty | 128/33 |
| 4,150,820 | 4/1979 | Bochmann | 272/86 |

*Primary Examiner*—Richard J. Apley
*Assistant Examiner*—S. R. Crow
*Attorney, Agent, or Firm*—Nelson E. Kimmelman

[57] ABSTRACT

A baby swing has a seat suspended from a horizontal rocking bar by two hangers. Mounted to the bar is a generally horizontally-mounted wheel or disc having a predetermined unequal weight distribution. A stationary DC motor drives the rim of the wheel which, as it rotates, causes the wheel and the shaft about which it revolves to rock back and forth, thereby also causing the rocking bar to do the same. The bar imparts corresponding swinging motion to the seat for a period of time determined by the current drain of the DC motor when operated from batteries.

26 Claims, 9 Drawing Figures

ELECTRICALLY-POWERED BABY SWING

BACKGROUND OF THE INVENTION

1. Field of the Invention

This invention relates to swings or the like, especially battery-operated swings for infants.

2. Prior Art

Swings for children have been known from time immemorial, starting with ordinary hand-pushed swings suspended from trees or other appropriate brackets. There have been non-electric swings patented in the United States as well as a number of AC motor-operated swings or vibrating devices such as shown in U.S. Pat. Nos. 3,311,935; 3,146,985; 2,916,745; 1,505,117; 2,564,547; and 2,609,031. U.S. Pat. No. 3,146,985 is typical of such pendular type play swings; which, since it requires an AC motor, is a relatively expensive assembly. As it operates off the household AC line, it involves higher voltages than are advisable where children are concerned. Furthermore, being AC driven, it requires line cords which limits its portability and presents hazards to children running or walking in the vicinity. Moreover, the use of an AC motor sufficient to drive the apparatus adds a considerable amount of weight to the item increasing its shipping cost and making it inconvenient to handle. The use of an AC motor does not lend itself well to sales of the item in knock-down form where the item is sold for ultimate assembly in the home by a handy consumer. The Beegle U.S. Pat. No. 2,590,920 which does not show a swing, but a health bed, has a driving assembly in which an AC motor is caused to circle around a horizontal disc. The weight of the motor about a moment arm causes the health bed involved to tilt first on one side and then on the other. Since an AC motor is used which rotates about the disc, it is necessary for Beegle to employ slip rings.

There has been a real need for children's or infants' swings of the portable type which are battery-operated yet which do not constitute an undue drain on the batteries or on the customer's pocketbook.

Recent U.S. Pat. No. 4,150,820 shows a battery-operated child's swing. It concedes that battery-operated swings have not been widely used for reasons previously mentioned, i.e., expensive AC motors, undue drain on battery current, etc. That patent also points out that some of those prior art swings could not tolerate the sudden stopping of the swing seat or the pushing of the seat in a direction contrary to its motor-driven direction because of the possibility of stalling of the swings or burning out of their motors. U.S. Pat. No. 4,150,820 shows the use of two nickel-cadmium rechargeable batteries from which the Bochmann apparatus shown can derive enough current to run 1½ or 2 hours. While 1½–2 hours is often adequate, it is considerably less desirable than a battery-operated swing which could operate at 10–12 times longer without recharging. Furthermore, the apparatus shown in that patent is relatively complicated and probably more expensive in its structure than it need be.

Accordingly, it is among the objects of the present invention to provide a battery-operated swing for children, or the like, which:

1. Has an appreciably lower current drain than known prior art swings.

2. Can operate for a considerably longer time on a single charge of rechargeable batteries than those presently known.

3. Is considerably more simple in construction than comparable prior art ones.

4. Is less expensive in terms of material and labor costs than those presently known.

5. Can utilize a very inexpensive small motor to drive the entire apparatus.

6. Is not disturbed by interruptions of the swing by stopping.

7. Does not require electric wires.

8. Is extremely portable.

9. Is extremely quiet in operation.

10. Can operate for a considerably longer time on conventional unrechargeable batteries than those presently known.

11. Has a smoother swinging action than many prior art swings.

12. Does not require any special linkage or clutch mechanisms to disengage the driving means from the swing itself should there be any stopping of the swing by any external force.

SUMMARY OF THE INVENTION

A baby swing or the like which has a subassembly that includes (1) weighted means being adapted to be coupled to the horizontal pendulum axis (axle) of the swing from which the baby seat is suspended and being capable of rotary movement and (2) motor means for causing said rotary movement of said weighted means, said motor means having a fixed spatial relation to said weighted means.

DETAILED DESCRIPTION OF THE PREFERRED EMBODIMENTS

Figure 1:
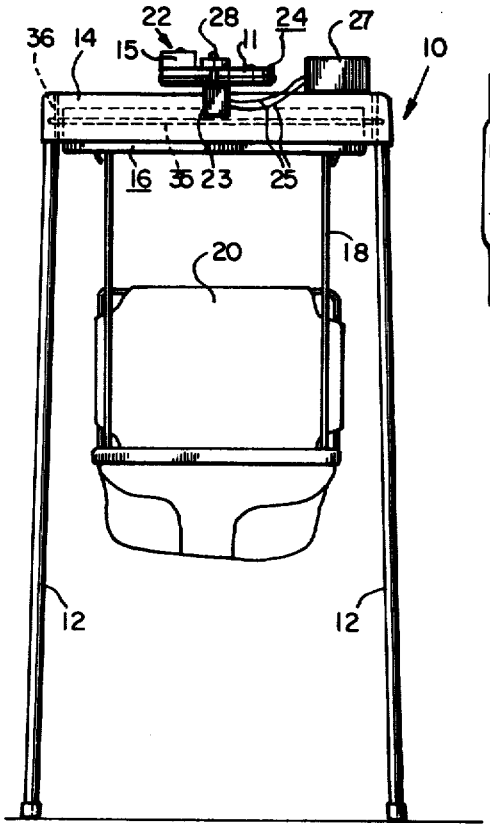
FIG. 1 is a front elevation view of the swing in accordance with one form of the present invention.
Figure 2:
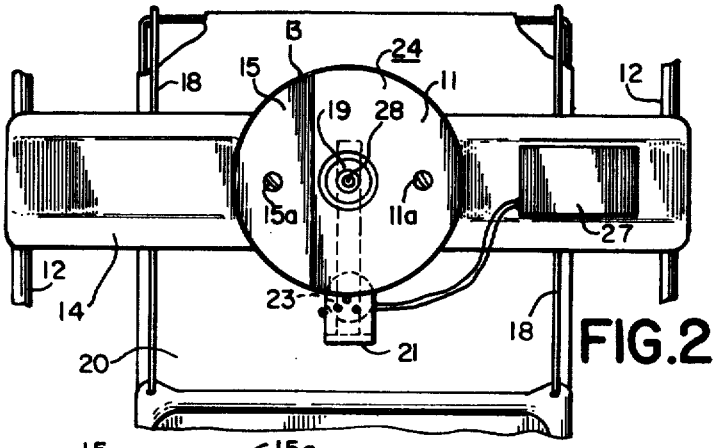
FIG. 2 is a plan view of the apparatus shown in FIG. 1.
Figure 3:
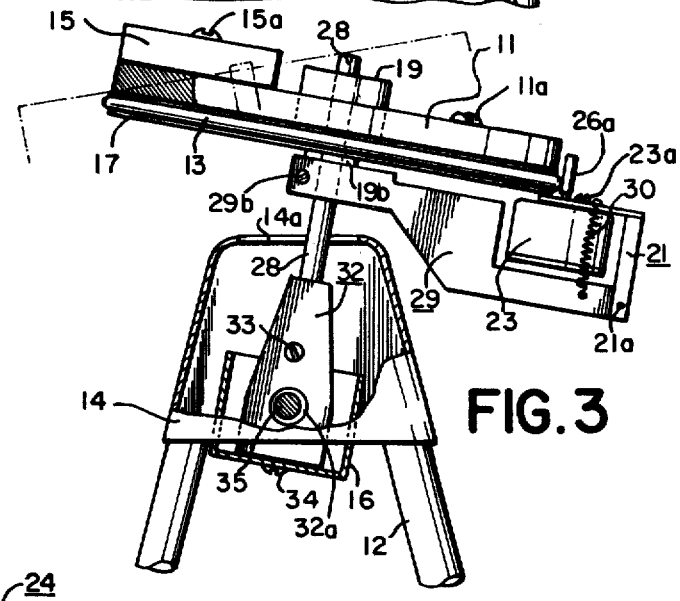
FIG. 3 is a fragmentary and partly broken-away end elevation view of the upper part of the apparatus shown in FIG. 1.

Referring to FIGS. 1–4, there is shown generally at the numeral 10 a novel battery-powered baby swing according to the present invention. Two pairs of angled legs 12 are attached to an upper horizontal frame member 14 to provide support for the apparatus. A rocking bar 16 is mounted on a horizontal axle 35 whose ends are journalled in apertures formed in vertical end members 36 fixed to the interior of frame member 14. Two hangers 18 are connected to the bar at their upper ends and to a baby seat 20 at their lower ends.

In order to impart movement of a rocking nature to the bar 16 and, indirectly, to the hangers 18 and seat 20, the assembly, indicated generally at numeral 22, is mounted centrally on top of the structure 14. A power supply 27, which may be several DC batteries, is coupled via leads 25 to a motor 23, the end of whose shaft 26 is used to drive the rim of a wheel subassembly 24 that revolves around fixed spindle 28. As shown in greater detail in FIGS. 2–4, the wheel subassembly 24 is mounted to revolve about the spindle 28 which is fixedly attached to a mounting block 32 arranged for rotary movement in unison with the rocking bar 16 that passes through it. Block 32 is, itself, secured by screw 34 to the bottom of the U-sectioned rocking bar 16. Fixed shaft 28 passes through the slot **14*a* formed in the horizontal structural member 14 and is journalled into an aperture in block 32, being fixed thereto by set screw 33**.

The assembly 22 also includes a bracket 29 clamped to the fixed shaft 28 by horizontal bolt **29*b* which tightens the portions of bracket 29 forming the keyhole slot 29*a*. Bracket 29 has an outer end portion 21 which is L-sectioned and can pivot about a pin 21*a* and which holds a DC motor 23 whose shaft 26 protrudes upwardly through an aperture in it. The upper end of the motor shaft 26 may be covered with a sleeve 26*a* of frictional material which is urged into contact with the rim of the wheel assembly 24 by the counter-clockwise bias exerted by tension spring 30 that is fastened to portion 21 and the lower part of bracket 29**.

Wheel subassembly 24 includes a lower plastic disc 17 with a peripheral groove into which a friction-increasing device such as a rubber band 13 is placed, the band making actual contact with the motor shaft sleeve **26*a*. The wheel assembly 24 also comprises heavy metal disc or wheel 11 and, atop disc 11, a heavy, chord-shaped metal piece 15. The function of the disc 11 is to serve as a flywheel and is used because the chord-like weight 15 causes the wheel to accelerate or decelerate when going down or up during a tilt of subassembly 24 causing large tangential forces to develop between the band 13 and sleeve 26*a*. The flywheel effect of disc 11 reduces this acceleration or deceleration and thus the wear on band 13 and sleeve 26*a***.

Figure 4:
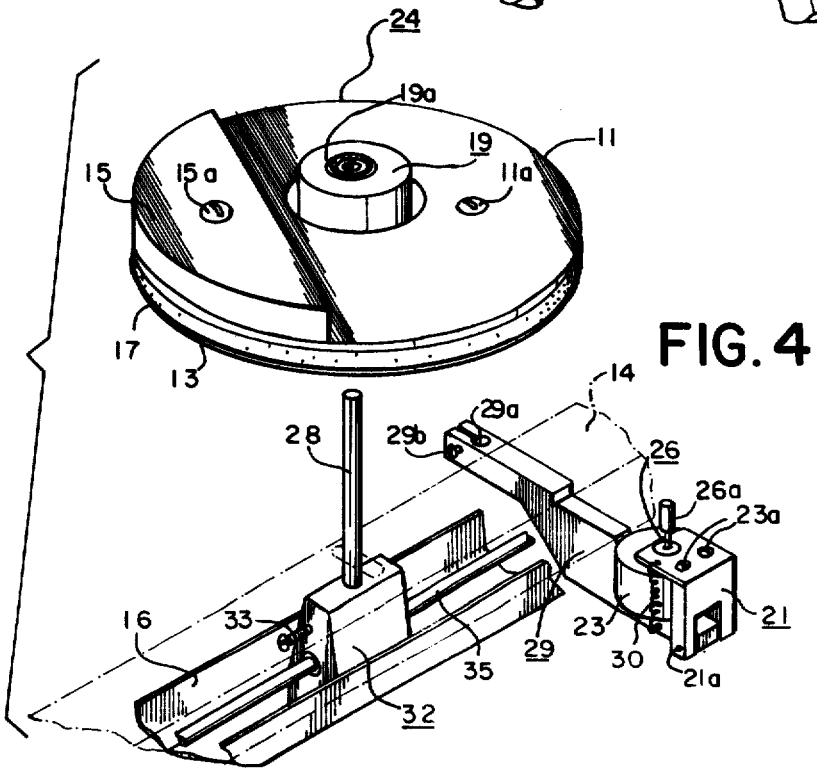
FIG. 4 is an isometric view, partly broken away and partly sectional, of the driving subassembly used in the apparatus shown in FIG. 1.

In the center there is a rigid plastic cylindrical member 19 into which a pair of bearings is inserted, one of them being shown in FIG. 4 at **19*a*. The member 19 may be secured onto the plastic disc 17 from below or be formed integrally therewith. A bushing 19*b* (FIG. 3) surrounds the shaft 28 just above the bracket 29 so as to support the subassembly 24** via the inner race of the lower bearing (not shown).

In operation, as the wheel subassembly 24 rotates, the heavy eccentric weight 15 exerts a torque on the subassembly which is transmitted through the stationary spindle 28, through the mounting block 32 to the horizontal rocking bar 16 from which the hangers 12 depend. This torque will cyclically change relative to a horizontal axis as the weight 15 rotates. To maintain sufficient amplitude of swing, the torque variations and the oscillation of the seat 20 should be near synchronous. More precisely, the phase angle between the seat oscillation and the drive weight rotation must not vary beyond established limits. Stated in another, general way, the position of the seat (with the child in it) must be synchronized with the angular position of the weight within small limits so that when the seat is at its two highest positions, for example, the weight is at approximately the same two rotary positions. This gives rise to operation at approximately resonant conditions. The maintenance of this phase angle or synchronous condition is achieved by a combination of factors and conditions which include the fact that the motor 23 is a DC type in which, for constant input voltage, the speed varies inversely with the load on the motor. Thus, if the motor has less work to do, it speeds up and vice-versa.

Theoretically, the sum of work done by the driving weight 15 in one complete rotation is proportionate to the weight times the swing amplitude times the cosine of the phase angle between the rotational angle of the weight and the angular displacement of the swing. Should the wheel start to slow down, the phase angle between the seat and the driving weight will begin to increase so that the work done by the drive weight will decrease. The motor, having less work to do, will speed up and will tend to catch up with the swing thereby decreasing the phase angle between the seat and the driving weight. Conversely, if the wheel starts to speed up, the phase angle will decrease and the work required of the motor will increase thereby slowing down the motor so that the phase angle will tend to be restored to its previous value. These mutually compensating effects tend to make the entire system stable. In designing the apparatus, a lagging phase angle of about 20° was chosen to be the point about which the system will tend to converge. Similarly, as the battery voltage lessens with use, the motor speed will lessen and the phase angle will increase. This will reduce the load on the motor which will in turn speed up thereby maintaining synchronization. (Actually, the effects of the lessening battery voltage may be counteracted by provision of a rheostat as will be explained later.) With less work available from the motor, the amplitude of the swing will lessen so as to maintain the input-output energy balance. One of the advantages of the self-synchronizing operation is that there is no criticality of timing of the starting push with the rotary position of the wheel subassembly.

As long as the energy supplied to the motor is below a certain threshold, the phase angle between the wheel and the seat motion will be greater than 0° and synchronization will be maintained. In operation, as the energy provided to the motor is increased (via reduced resistance, new batteries, etc.) the phase angle will decrease, resulting in a greater energy input to the wheel, and thus, a larger amplitude swing. Since the work done is proportionate to the weight times the swing amplitude times the cosine of the phase angle, as the swing amplitude builds up, the cosine of the phase angle will decrease (angle will increase) such that the angle will converge toward its previous value. Hence, the lagging phase angle of the drive system is inherently stable and thus the swing remains in synchronization.

The dimensions of the wheel and its other characteristics depend upon a number of factors. One of these is density; the more dense the material, the smaller the overall size. It has been found from operations that a 6" OD×2" ID×¾" thick iron wheel and a 1½" wide×¾" thick chord provide sufficient rotational inertia and unbalanced weight, respectively. If the disc were 5" OD, a thickness of 1½" would be necessary. If lead were used, a 5" OD wheel would need be only 1" thick; a 4" OD wheel would be about 2" thick. Since the motor sleeve drives the wheel at its rim, as the OD of the wheel is made smaller, the force required at the rim will become proportionately larger, a limiting factor.

Since the pendulum swings at about 40 times per minute, for a desired motor speed of 2000 rpm, a rim-to-motor sleeve ratio of about 50 is required. With the motor used at 2000 rpm, sufficient power is obtained from a 2 volt source which is an economical arrangement for battery-operated devices. Using 2 "C" nickel-cadmium batteries, the swing will operate for about 20–25 hours between charging.

Alternatively, "D" sized batteries of the carbon-zinc type would operate, assuming an average current drain of 60 milliamps, for 100 hours. If the current drain is kept lower, say 50 milliamps, the "D" batteries might operate to about 120 hours.

Figure 5:
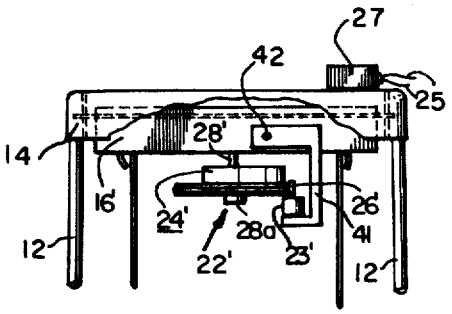
FIG. 5 is a front elevation, fragmentary view of another form of the invention in which the driving subassembly is located under the rocking bar.

FIG. 5 shows an alternative mounting for the apparatus 22'. In this form, the apparatus is mounted to bar 16' below the support structure 14 and its wheel subassembly 24' is mounted for rotation about a fixed spindle 28' whose upper end is connected to the rocking bar 16'. A member **28*a* is attached to the lower end of the spindle 28' to help support the wheel subassembly 24'**.

In that embodiment, the motor 23' is mounted on a generally C-sectioned bracket 41 so that its driving shaft 26' is in contact with the rim of the wheel 17. In order to maintain the motor shaft 26' in contact with the rim of 24', the entire bracket 41 may be mounted so that, because of the weight of the motor 24', it pivots clockwise about a pivot pin 42 which is fastened to the rocking bar 16'.

Instead of a pivoting arrangement, the bracket 41 could have a spring-biased portion as explained in connection with FIGS. 1–4. This embodiment has the advantages of taking up less overall volume than the previous embodiment. However, it may not be suitable under certain circumstances as it may impede somewhat the insertion or removal of the baby from the seat because of the lessened clearance.

Figure 8:
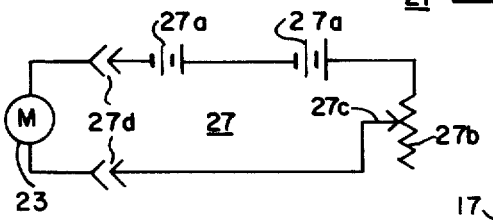
FIG. 8 is a schematic diagram of the power supply for the driving subassembly shown in the previous embodiments.

A circuit of the power supply 27 is shown in FIG. 8 and comprises two batteries **27*a* in series with a variable resistor or rheostat 27*b* whose movable arm 27*c* is connected via one of the plug-socket or other connecting means 27*d* to one terminal of the motor 23. The other of the plug-socket means 27*d* connects the other motor terminal to the battery. If two nickel-cadmium batteries are used, the rheostat 27*b* may have a value of 20 ohms, for example. The variable resistor 27*b* is set, when the batteries are fresh, toward the larger voltage-drop end of the rheostat 27*b***. As the end of the battery life (or charge in the case of rechargeable batteries) approaches, the voltage supplied by them becomes less, so that instead of 1.3–1.5 volts, it is only 1.0 or 0.9 volts. Therefore, as the battery ages, it is advisable to turn the knob of the rheostat to produce a lessening voltage drop. In this way, it is possible to equalize the voltage to the motor and thereby adjust the amplitude of the swing to be relatively constant.

Figure 6:
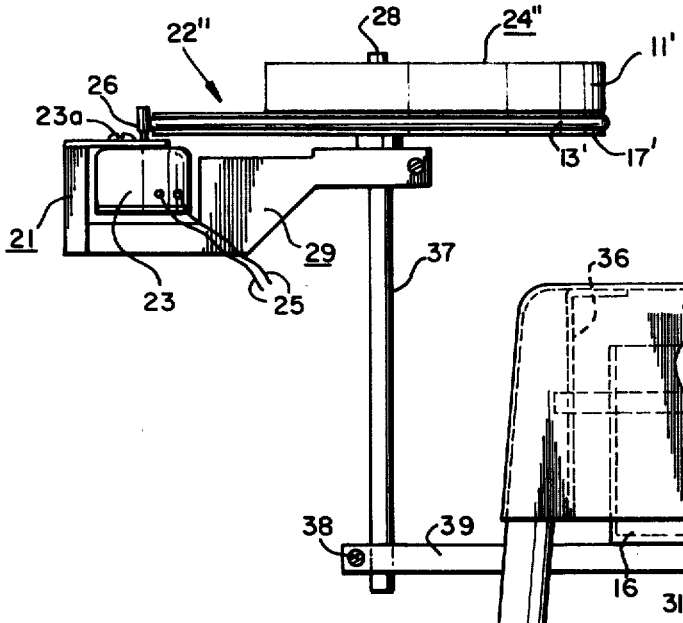
FIG. 6 is a fragmentary, front elevation view of another form of the invention in which the driving apparatus is positioned at one end of the rocking bar.
Figure 7:
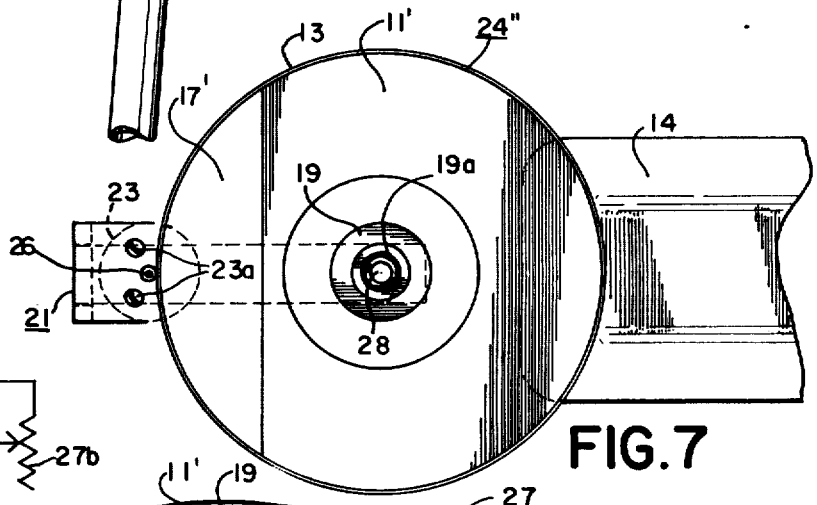
FIG. 7 is a plan view of part of the apparatus shown in FIG. 6.

FIGS. 6 and 7 show a slightly different wheel subassembly 24" and a somewhat different way of mounting the modified driving apparatus 22' to the swing. In the embodiment of FIGS. 1–4, it was seen that the motor spindle was fixedly attached during manufacture of the entire swing above and to the U-sectioned rocking bar 16. In the embodiments of FIGS. 6 and 7 the assembly 22" is made to be added on toward one end of an existing swing which originally was powered by a hand-wound spring motor.

In this embodiment, the subassembly 24" comprises a plastic disc 17' having a groove formed in its rim into which a friction band 13' is placed. Instead of a three-piece wheel system as explained in conjunction with FIGS. 1–4, there are two pieces: a disc-like metallic member 11' from which a chord-shaped section has been removed and disc 17. It has been found that this simpler wheel structure will produce the desired rocking of the assembly 22" as well as the more complicated form shown in FIGS. 1–4. It will also produce approximately the same flywheel effect as explained above.

In order to enable this embodiment to be added to an existing swing (or to be built into a swing during manufacture), the fixed spindle 37 is quite long and, after passing through a hole in the bracket 29 to which it is attached, extends down to a point just below the lower edge of the horizontal structural member 14. A horizontal rigid member 39 is attached to the lower end of the shaft 37 and its other end is secured to the underside of the rocking bar 16 by screw 31.

Figure 9:
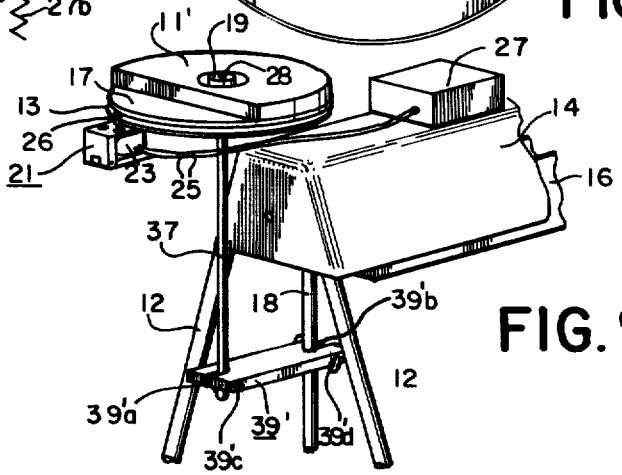
FIG. 9 is a fragmentary, perspective view of another way of mounting the driving subassembly of FIGS. 6 and 7 to a swing.

FIG. 9 is a view showing how the driving apparatus 22" may be added to an existing swing when it is not possible, for example, to affix the cross member 39 to the rocking bar as shown in FIGS. 6 and 7. Instead, there is provided a rigid member 39' having provisions for engaging, toward one end, the lower end of the extended spindle 37 and, on the other end, the hanger 18. The rigid coupling member 39' has at each end an aperture **39'*a* or 39'*b* to engage the spindle 37 and the hanger 18 respectively. Slotted aperture 39'*a* may be clamped around the spindle 37 by tightening a horizontal adjusting bolt 39'*c* whereas the U-shaped slot 39'*b* is narrowed somewhat by screwing in the adjusting wing nut 39'*d***.

In the embodiments of FIGS. 6 and 9, the driving assembly 22' is shown with the bracket 29 extending to the left of the wheel subassembly 24" (as seen from the front). However, in practice, it is just as likely to be placed 90° more clockwise around the spindle 37 so that it is behind the subassembly 24" as seen from the front or at any other angular position. The power supply 27 may be placed on any convenient supporting surface or attached to the swing in any way that may make the driving unit even more compact.

GENERAL REMARKS

The various forms of the invention which have been shown and explained have involved a revolving weighted member which is in the nature of a wheel or wheel segment or disc-like member. However, it should be appreciated that the same effects can be obtained by having a weighted member of any shape disposed at one end of a radial arm of equivalent which is connected at the end of a generally vertical rotating shaft that is mounted to the horizontal axle means. The motor means could be coupled directly or indirectly to drive the shaft so that when the shaft is rotated, it would impart the tilting or rocking motion to the horizontal axle means and thence, via the hanging elements, to the seat.

It is also within the general ambit of this invention that the rotating member, be it a wheel, disc, partial wheel or disc, or a weight mounted toward the end of a radial arm can traverse less than 360°. The wheel-like or other weighted member could be caused to rotate by a motor from 0° to 180° during which time it would cause the horizontal axle means to rotate somewhat about its axis thereby initiating a swing in one direction. Then, during the interval in which the wheel would ordinarily revolve through the next 180°, the motor would be deenergized so the wheel would remain immobile thereby allowing the horizontal axle means to return by gravity on the back swing. When the end of the back swing is detected (or timed), the motor would be reenergized so as to cause the wheel to move in the opposite direction within the same or 180° arc; thereby moving the weight in the same arc and causing corresponding tilting of the wheel and horizontal axle means as in the forward swing.

The invention has been described in terms of a DC motor, but it may be that under certain circumstances an AC motor is preferable. In that case, the invention contemplates that means could be provided for applying AC directly to the motor or generated an AC voltage by an appropriate sold-state circuit connected to a battery means.

Although electrical energy is preferable for most applications of this type, some of the structural embodiments of this invention could be used with a mechanical motor, but to achieve long times of operation comparable to those achieved by battery operation, considerable manual winding may prove to be necessary.

As shown in the various embodiments, the motor drives the rim of a plastic disc 17 or 17' via a rubber or similar band 13 or 13' positioned on the rim. However, the disc 17, 17' is not essential and serves in those embodiments to enable the flywheel-weight combination to be continuously rim-driven. Alternatively, for example, the disc 17 or 17' could be dispensed with and a single cast or otherwise formed member of metal could incorporate the functions of the wheel (flywheel) 11, the weight 15 and the drive disc 17. In that case, a rubber band could be placed around the circular rim of the one-piece member.

What is claimed is:

1. In a baby swing combination which includes horizontal pendulum axle means from which a seat is suspended, the combination comprising:

(a) weighted means adapted to be coupled to said axle means and capable of rotary movement in a generally horizontal plane, and (b) non-rotating motor means coupled to said weighted means for causing said rotary movement of said weighted means whereupon said axle means is caused to have cyclical rotary movement about its axis thereby causing said seat to swing, said motor means being immobile relative to said weighted means.

2. In a baby swing combination according to claim 1 wherein said weighted means includes a wheel means having an unequal weight distribution.

3. In a baby swing combination according to claim 1 wherein said rotary movement of said weighted means is repetitive through 360° cycles.

4. In a baby swing combination according to claim 2 wherein said predetermined unequal weight distribution is selected to cause said wheel to be tilted in at least two mutually opposite directions during each complete revolution of said wheel means, said tilting occurring substantially symmetrically on each side of said horizontal pendulum axle means.

5. In a baby swing combination according to claim 1 wherein said motor means includes an electric motor.

6. In a baby swing combination according to claim 5 wherein said electric motor is DC energized.

7. In a baby swing combination according to claim 6 wherein said DC motor is battery-driven.

8. In a baby swing combination according to claim 2 wherein said wheel means is a partial wheel.

9. In a baby swing combination according to claim 2 wherein said motor means drives the rim of said wheel means.

10. In a baby swing combination according to claim 2 wherein said wheel means is mounted for rotation about a generally vertical spindle and said motor means is mounted on a support means fixed to said spindle.

11. In a baby swing combination according to claim 2 wherein said wheel means and said motor means are mounted above said horizontal axle means.

12. In a baby swing combination according to claim 2 wherein said wheel means and said motor means are mounted near one end of said horizontal axle means.

13. In a baby swing combination according to claim 1 wherein downwardly-extending members are respectively coupled to said horizontal axle means at one end and to said seat at the other for suspending the latter and further wherein means are provided for rigidly joining said wheel means and said motor means to said horizontal axle means.

14. In a baby swing combination according to claim 13 wherein said wheel means and said motor means are disposed below said axle means centrally thereof and coupled thereto.

15. In a baby swing combination according to claim 13 wherein said wheel means and said motor means are disposed toward one end of said axle means and coupled thereto from below.

16. In a baby swing combination according to claim 1 wherein said wheel means and said motor means are detachably coupled to said axle means.

17. In a baby swing combination according to claim 2 wherein said wheel means comprises a disc member and a weight member affixed thereto, said disc member having friction means at its edge.

18. In a baby swing combination according to claim 17 wherein motor means are positioned near the rim of said disc member and has a shaft which makes contact with said friction means to drive said disc member and said weight in unison.

19. In a baby swing combination according to claim 18 wherein said disc member is constructed to serve as a fly-wheel to reduce variations in the speed at which said disc-like member rotates and further wherein said weight is shaped like a chord having its curved edge located near the edge of said disc member.

20. In a baby swing combination according to claim 19 wherein said disc member is made of metal and wherein said weight member is also made of metal.

21. In a baby swing combination according to claim 17 wherein said wheel means also includes a second disc member made of a non-metallic material and wherein said motor means is positioned to have its shaft make substantial contact with the rim of said second disc-like member.

22. In a baby swing combination according to claim 6 with the addition of means for supplying a substantially constant DC battery voltage to said motor means as the voltage furnished by said batteries declines in use.

23. In a baby swing combination according to claim 22 wherein said means for supplying a substantially constant voltage comprises a variable resistance means.

24. In a baby swing combination according to claim 1 wherein said wheel means and said motor means are mounted for rocking in unison as said wheel means engages in rotary movement and further wherein synchronism is substantially maintained between the rotary position of the weight and the position of the seat in its oscillations.

25. In a baby swing combination according to claim 2 wherein said weighted means includes a first disclike means positioned to have its edge engaged by said motor means to be driven thereby and further includes a second disc means having a portion thereof removed, said first and second disc means being fastened together, said second disc means being extremely heavy relative to said first disc means and serving to act as a fly-wheel while at the same time causing said wheel means to rock on at least one side as it engages in rotary movement.

26. In a baby swing combination according to claim 25 wherein said first disc means includes friction means on its edge with which said motor means is brought into contact.

* * * * *